United States Patent [19]

Vestre et al.

[11] 3,964,146

[45] June 22, 1976

[54] MEANS FOR ASSEMBLY OF TUBE BANKS IN HEAT EXCHANGERS

[75] Inventors: Rasmus Vestre, Oslo; Oddvar Kaurin Augland, Osteras, both of Norway

[73] Assignee: Norsk Hydro A.S., Oslo, Norway

[22] Filed: Apr. 10, 1974

[21] Appl. No.: 459,852

[30] Foreign Application Priority Data

Apr. 10, 1973 Norway ..... 1466/73

[52] U.S. Cl. ..... 29/202 R; 165/162; 29/157.4

[51] Int. Cl.[2] ..... B23P 15/26

[58] Field of Search ..... 29/202 D, 202 R, 200 B, 29/157.3 R, 157.4; 165/162

[56] References Cited

UNITED STATES PATENTS

| | | | |
|---|---|---|---|
| 1,967,961 | 7/1934 | Metten | 165/162 |
| 3,789,479 | 2/1974 | Zifferer | 29/202 R |
| 3,820,594 | 6/1974 | Ritland et al. | 165/162 X |
| 3,837,397 | 9/1974 | Pettigrew | 165/162 |

FOREIGN PATENTS OR APPLICATIONS

| | | | |
|---|---|---|---|
| 6,163 | 6/1905 | United Kingdom | 29/157.3 R |

*Primary Examiner*—C.W. Lanham
*Assistant Examiner*—V. K. Rising
*Attorney, Agent, or Firm*—Wenderoth, Lind & Ponack

[57] ABSTRACT

A device for fixation of tubes in tube banks in heat exchangers with longitudinal flow externally of the tubes comprises a plurality of longitudinally spaced tube support grates having bars extending transversely between the spacings between the tubes. The grate bars are provided in such manner that the bars in any two arbitrarily selected neighboring grates impart their supporting function by alternating oppositely directed pressure transversely of each of the tubes.

8 Claims, 8 Drawing Figures

MEANS FOR ASSEMBLY OF TUBE BANKS IN HEAT EXCHANGERS

BACKGROUND OF THE INVENTION

The present invention relates generally to improvements in tube banks in heat exchangers, more particularly new means for the assembly or fixation of the tubes in a tube bank heat exchanger for longitudinal flow externally of the tubes of the kind provided with a plurality of mutually spaced support grates or the like with bars running through the free spacing between the tube racks.

The invention is developed in connection with heat exchangers for use in the chemical industry, for instance for petro-chemical processes wherein large heat quantities via correspondingly large gas quantities, frequently having relatively high pressure shall be interchanged with other gas volumes, high pressure feed water - steam or other fluids.

Heat exchangers in accordance with the invention can, however, also be utilized in connection with more conventional operations.

When for instance, heat is transferred from a gas quantity having lower or intermediate pressure to for instance high pressure steam or feed water, it is frequently known for productivity and economical reasons to convey the fluid having the higher pressure through U-shaped tubes. Thereby it will be sufficient to operate with one single tube plate and one cover for the high pressure. In order that the heat exchanger shall be able to operate on the basis of pure counter current principles, it is possible to arrange a baffle in the mantle, between each branch of the U. For assembling or fixation of the tubes there is then usually provided combined support- and conveying plates (baffles) which with regard to the support must consume at least one half of the cross-sectional area. The gas is then led partly longitudinally and partly transverse relative to the tube bank. The area available for gas flow and defining the gas velocity will in this manner then only amount to about ¼ of the cross-sectional area of the mantle divided by the total cross-sectional area of the tubes (i.e. the open cross-sectional area between the tubes). In order to limit the velocity and pressure losses to acceptable values and simultaneously keeping the dimensions on high pressure parts within certain limits, it is frequently necessary to divide the assigned heat exchange task among several parallel units.

It is possible to let the gas flow in one direction only and obtain utilization of one half of the free cross-sectional area between the tubes. The counter current principle is then abandoned, a fact which with regard to the temperature difference may make it necessary to have two heat exchangers in series.

The gas flow transversely and longitudinally results further in relatively large pressure losses and also in great variations in velocities and leads to risk of vibrations. Such can also be formed due to the fact that the apertures in the baffles must be made with a certain clearance for the tubes.

Regarding the heat transfer number (coefficient) on the gas side, it is generally accepted that the combination of longitudinal and transverse flows which is obtained by means of baffles, gives a higher heat transfer number than pure longitudinal flow, provided the same Reynold number is prevalent. (A dimensionless number designating the heat transfer, the value of which depends upon the mass flow, characteristic dimensions (tube diameter) and viscosity).

With conventional calculation methods the above conclusion is correct in connection with heat exchangers subjected to low or intermediate load (Reynold numbers being less than approximately 20 – 30,000). At higher Reynold numbers these conditions will however, move towards a benefit when using pure longitudinal flow, such that at Reynold numbers of about 100,000 – 300,000 which frequently prevail in highly loaded heat exchangers as before mentioned, the heat transfer number on the gas side will be considerably higher at longitudinal flow. The calculations will then also be more correct since one can utilize the calculation methods applicable for fluid flow in tubes.

With regard to the condition that heat transfer conditions at large Reynold numbers are better at pure longitudinal flow than at combined transverse- and longitudinal flow, the inventors believe that the uneven velocities and the "dead zones" prevailing at the latter flow pattern will make a greater influence at higher Reynold numbers.

SUMMARY OF THE INVENTION

On the basis of the factors mentioned above, the inventors have found that at higher Reynold numbers it will principally be more favourable to use pure longitudinal flow externally of the tubes in tube bank heat exchangers than combined transverse- and longitudinal flow by means of baffles and which solution hitherto has been most utilized.

The general object of the present invention is to provide improvements in tube bank heat exchangers having pure longitudinal flow, and which, firstly, renders the least possible reduction of the free cross-sectional area between the tubes, and secondly, simultaneously gives a so rigid assembly or fixation of the tubes that no risk exists that vibrations and/or fractures shall take place at those large mass flows which may take place.

There are known several designs for grate bars and other assembly means, the particular aim of which are to maintain the largest possible part of the open cross-sectional area. Reference may be made for instance to Swedish patent No. 219,944 which relates to assembly means in the shape of wave- or zigzag-shaped elastic plate strips which are arranged transversely through the continuous spacing between the tubes such that the strips are in contact with adjacent tubes in staggered fashion, whereby the strip material yields or is put into tension from tube to tube. It is however, assumed obvious that such a method of assembly will not be sufficient if the task concerns heat exchangers which operate subjected to high loads and large gas quantities.

At this point it shall be remarked that the problem of assembling the tubes will be more difficult for two reasons when the spacing between the tubes get smaller, firstly because it then will be more important to maintain as much as possible of the free cross-sectional area therebetween such that the same is available for the gas flow and secondly, that the reduced space will make it difficult simultaneously to obtain sufficient mechanical rigidity in the assembly means.

The means in accordance with the invention therefore relates to binding off or fixation of tubes in a tube bank heat exchanger for longitudinal flow externally of the tubes, and comprising a number of spaced support bar grates having bars extending through the spacing between the tubes, and the means in accordance with the invention is generally characterized therein that the bars are provided in such fashion that the bars in any two adjacent grates exercise their supporting effect by exerting alternating opposite directing pressure transversely on the tubes. Thus, in regard to gas flow it is possible to maintain an optimal part of the free cross-sectional area between the tubes and simultaneously to fix the bar grates in a simple and dependable fashion.

There is previously known fixation means for the tubes in tube banks wherein the tubes are tensioned by being subjected to lateral pressures, but in the prior art the grate and bar elements — and not the tubes — have contributed with the substantial part of the flexible support.

The invention may be realized in various manners. In one embodiment the bars at each grate cross-section alternately extend through a certain fraction of the consecutively existing spacing between the tubes, the tubes being fixed in that they are tightened or subjected to tension by alternating transversely directed displacement and fixation of the respective bar grates. In a second preferred embodiment which is particularly suitable for tube banks having a relatively large tube pitch the bars can extend through all spacings between the tubes, the invention being realized in that the bar grates have openings or masks wherein the bars may be thinner than the spacings between the tubes, and the tensioning and fixation of the tubes are obtained in that the grates are displaced in a direction transversely of the tubes and preferably diagonally relative to the masks or corners in the grate and preferably in alternating directions at each subsequent grate. This embodiment implies several important advantages.

In the longitudinal direction the grates may be positioned having equal spacing or distance therebetween along the entire length of the tube bank or in that two grates, respectively three or four, are positioned relatively close to each other in a common holder or basket means or a "grate unit", and having a suitable distance to the next grate unit.

By means of the beforementioned assembling- or fixation system for the tubes in the tube bank there are obtained several advantages. Firstly, about 70% – 90% of the free cross-sectional area between the tubes will be available for gas flow, and simultaneously the tubes will be supported and fixed in a dependable and firm manner.

Furthermore, the binding and fixation of the tubes will require use of relatively small quantities of material in the grate- and bar system, a fact which may be of economical importance since it frequently concerns a relatively expensive material, such as stainless steel.

Furthermore, it will be possible to, with the same pressure loss, operate with greater velocities than what would be the case with a conventional design, and in consequence thereof also due to the above mentioned condition, namely improved heat transfer at longitudinal flow and large Reynold numbers, to obtain considerably smaller demand to necessary transfer surfaces.

BRIEF DESCRIPTION OF THE DRAWINGS

In the following the invention shall be described in connection with certain embodiments thereof which are shown schematically in the accompanying drawings, wherein:

FIG. 3 is a detail view along the cross-sectional plane III—III in FIG. 4, while

DETAILED DESCRIPTION OF THE INVENTION

Figure 1A:
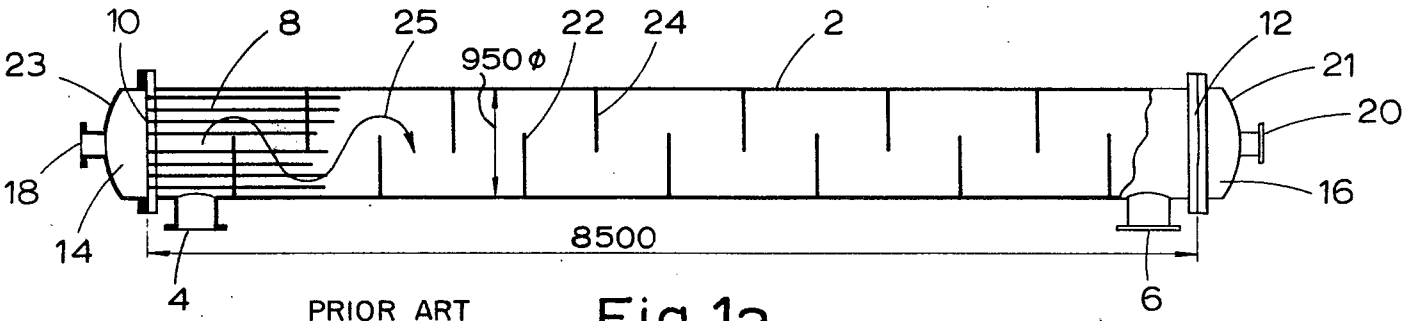
FIGS. 1*a* and 1*b* are views schematically showing longitudinal sections through a conventional heat exchanger with baffles and a heat exchanger made in accordance with the principle of the invention, respectively. The Figures have been drafted at the same scale and illustrate heat exchangers having equal working capacity and the same pressure loss, and wherein a gas at a pressure of 30 atm. and specific gravity of 10 kg/m$^3$, transfers heat for instance to feed water flowing through the tubes.

FIG. 1*a* shows a schematic longitudinal section through a conventional lengthwise flow heat exchanger with a mantle 2 provided with inlet-/outlet fittings 4 and 6. In the mantle 2 is provided a tube bank 8 having parallel tubes extending between headers 10 and 12 with collecting chambers 14 and 16 with fittings 18 and 20 in the curved heads 21 and 23. In the mantle in the usual fashion are provided alternately staggered baffles 22 and 24 insuring that the gas flow through the heat exchanger mantle attains a zigzag course as indicated with the line 25. The shown heat exchanger is as known designed for transfer of heat from a gas of 30 atm pressure, specific gravity of 10 kg/m$^3$, to for instance feed water flowing through the tubes in the tube bank.

Figure 1B:
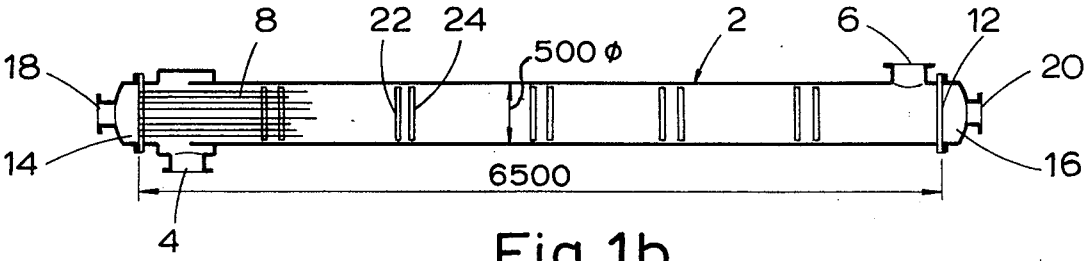

FIG. 1*b* shows for illustration purposes a corresponding lengthwise flow heat exchanger wherein the tube bank is assembled in accordance with the present invention, and otherwise is designed to have a capacity corresponding to the heat exchanger shown in FIG. 1*a*, and thus having the same pressure loss on the gas side. Equal numbers in FIGS. 1*a* and 1*b*, respectively, designate otherwise equal parts. The heat in accordance with the invention demands as a result of the improved means of assembly only ⅓ of the cross-sectional area compared with the conventional heat exchanger shown in FIG. 1*a*, and attains thereby correspondingly smaller outer dimensions such as shown in FIGS. 1*a* and 1*b*.

Figure 2:
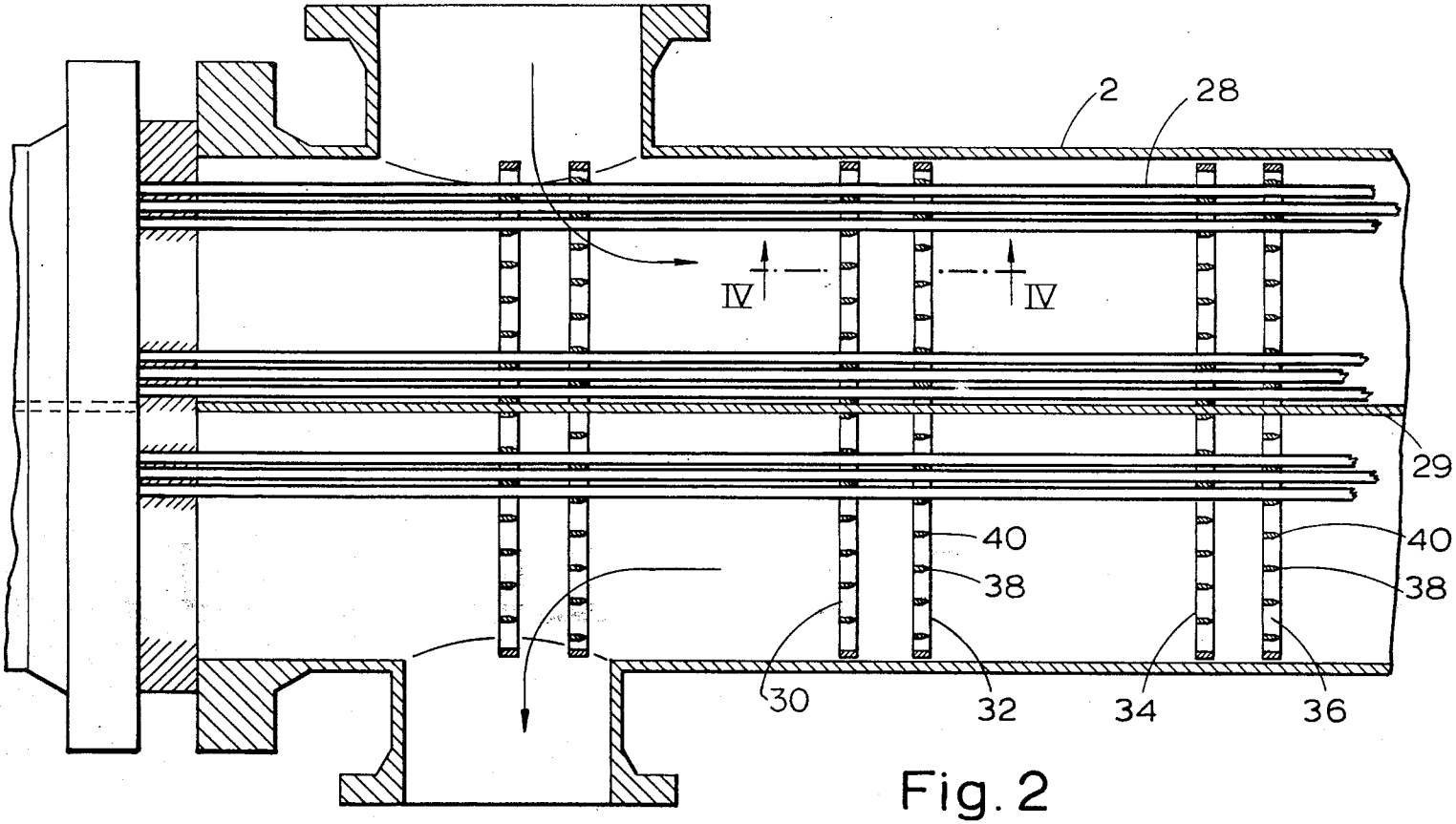
FIG. 2 is a fragmentary longitudinal section through a heat exchanger provided with the means in accordance with the invention.

FIG. 2 shows a schematic longitudinal section seen at an enlarged scale of a section of a heat exchanger in accordance with the invention having a U-shaped tube bank and a separating plate 29 along the centerplane. As shown the tubes in the tube bank 28 are assembled and fixed in the mantle by means of transfer bar grates 30, 32, 34, 36, each of which are provided with parallel, identically equal grate bars 38, 40 etc. The bar grates are in order to simplify the mounting, such as shown, provided with unequal spacing lengthwise through the tube bank such that the grates are provided in pairs 30, 32 and 34, 36 etc., having a suitable mutual distance or pitch such as otherwise shown in FIG. 1*b*. The grate bars extend only through each second consecutive tube spacing and are configurated and positioned such that the tubes are imparted an oppositely directed lateral pressure when viewed from grate to grate. The design of a heat exchanger as shown in FIGS. 1*a*, 1*b* and FIG. 2 appears in more detail in FIGS. 3 and 4. In these figures the mantle is likewise designated with reference number 2. Each of the bar grates 30, 32 comprises an annularly shaped framing 50, 52 made of steel plating having an external diameter somewhat less than the inside diameter of the mantle. In the bar grates 30 and 32 are mounted — suitably by welding — parallel sets of bars, designated 56, 58, 60 and 62, 64, 66, respectively, extending between rows of parallel tubes in the tube bank. Bars extend as shown only through each second pipe spacing at each bar grate. While the bars 56, 58, 60 extend in the spacings designated I, III and V, the bars 62, 64, 66 in the adjacent grate 32 extend through the "in between spacings" designated II, IV and VI. Transversely of and in between grate bars in each grate are furthermore at suitable mutual distances located transverse parallel stiffening elements 68.

The grate bars can be made as even, plane parallel bars having a thickness somewhat greater than the nominal clearance or distance between the tubes in each consecutive pipe spacing, and the assembly of the tube bank takes place in that the bars are pushed in between the tubes in the bank, whereby all adjacent tubes in the pipe plane in question then will be displaced a small distance laterally and subjected to a certain elastic tensioning or deformation. Alternatively the tubes can be pressed in their longitudinal direction between the bars. Notwithstanding the mounting method all tubes in the bank will then be fixed subject to a certain alternating lateral tensioning from grate to grate in consequence of the alternating position of the grate bars. Hereby is obtained that at each grate are located bars only through each second spacing between the tubes, whereby is maintained a free space (i.e. unobstructed flow area) between the tubes along each second pipe spacing consecutively across the grate section. At the embodiment for the invention illustrated in FIGS. 3 and 4, the pipe grates are made considerably thicker than the spacing between the tubes in that the bars are as shown serrated with circularly shaped seats 70, 70 etc., conformed to the tubes such that the same receive a steady support and are also laterally supported. Such seats serve also as guides during the assembly. In the shown embodiment it is not necessary to subject the tubes to substantial lateral tensioning during the mounting operation, but the fit ought to be so narrow that rattle sounds and vibrations are avoided. Furthermore, the bars are rounded off and/or are pointed along the side edges 74, in the direction of the gas flow as indicated with the arrow 75 in order to reduce the gas flow friction.

Figure 3:
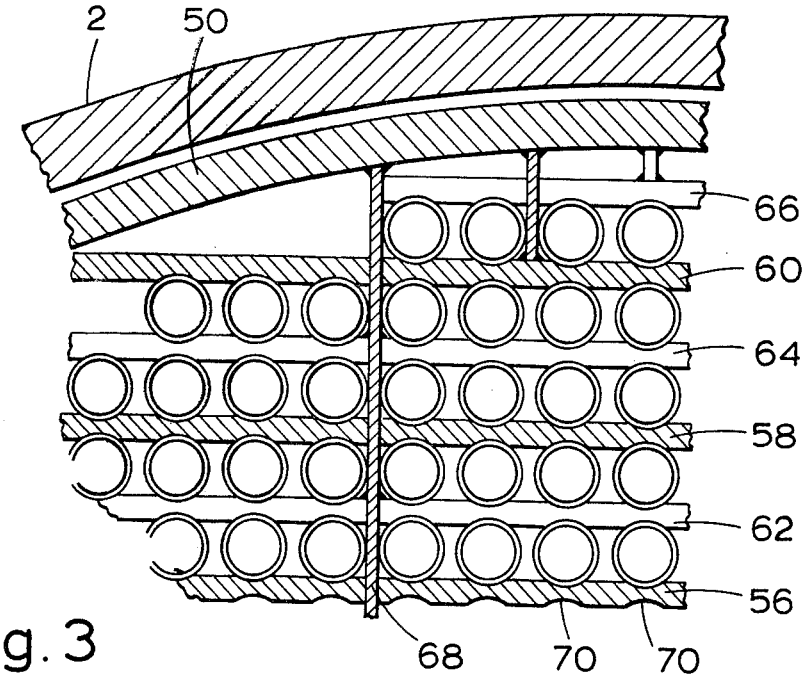
Figure 5:
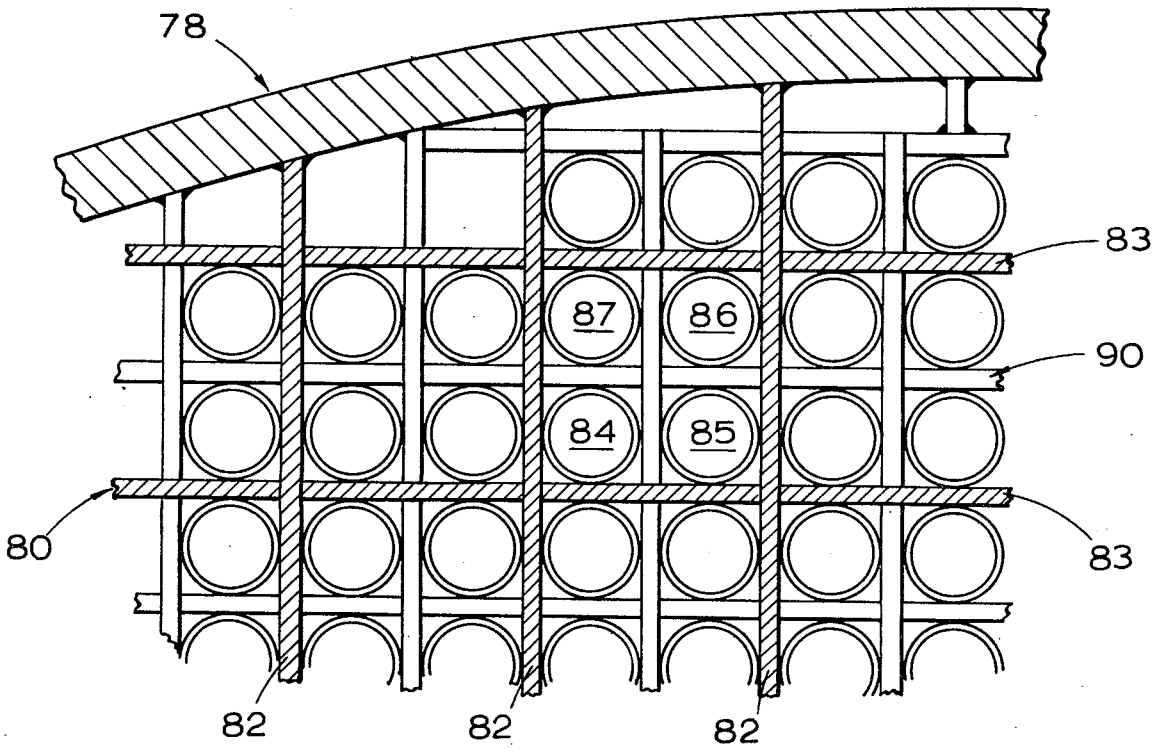
FIG. 5 is showing a transverse cross-sectional detail view similar to FIG. 3 of a preferred embodiment of the invention.

FIG. 5 shows a detail section similar to FIG. 3 of a modified preferred embodiment of the invention.

Herein the bar grates 78 are provided with rods assembled as a net of grid-shaped, square masks 80, such that parallel rod elements 82 extend in one direction and other rod elements 83 extend perpendicularly to rod elements 82. The grid- or "rod masks" are mutually identically equal and are each accurately adapted for encompassing a group of four adjacent tubes 84, 85, 86, 87 (disregarding the grid masks along the circumference of the tube bank whereat the number of tubes necessarily will be smaller). Furthermore, the masks in the bar grate are alternately laterally displaced one tube pitch in both directions from support grate to support grate (diagonally displaced) such that the bar masks 90 in the adjacent (rearwardly) positioned support grate (not hatched) are positioned as illustrated in FIG. 5. In this embodiment one obtains principally the same effect as with the embodiment shown in FIGS. 3 and 4 although with the difference that each tube herein is fixed at two biasing points 90° angularly displaced along the circumference of the tube at each support grate. Preferably, although not necessarily, the bars should in this embodiment have a thickness which is somewhat larger than the space between the tubes such that the grates and the tubes in the bank when assembled subject the tubes to a certain elastic tensioning. Otherwise it also in this embodiment is maintained a full free opening between each second tube spacing along the cross-sectional space through each support grate.

Figure 4:
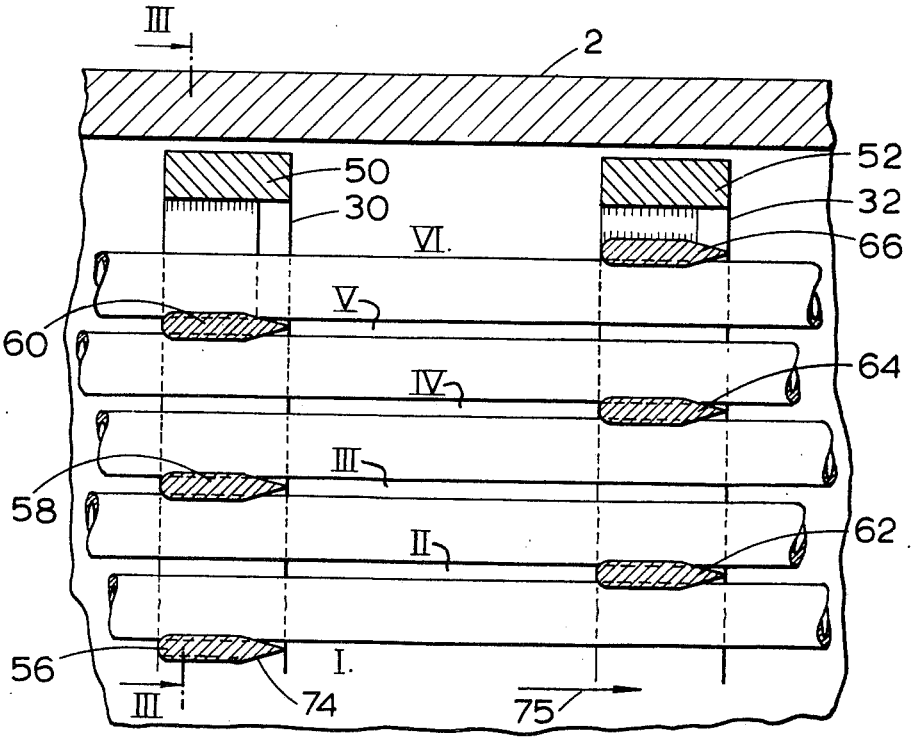
FIG. 4 is a cross-sectional detail view showing the same detail along the plane IV—IV in FIG. 2.
Figure 7:
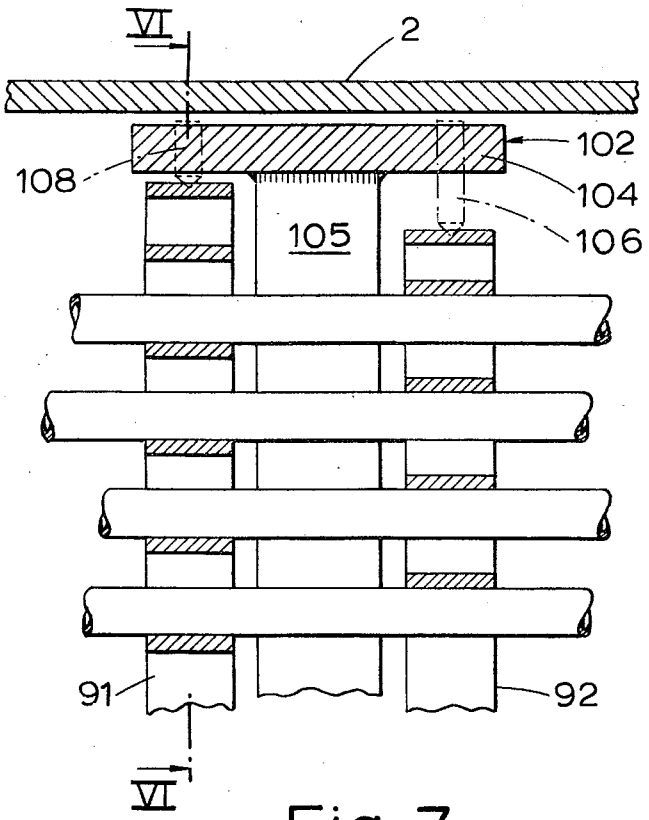
FIGS. 6 and 7 are detail views, showing a cross-sectional view and a longitudinal view, respectively, similar to FIGS. 3 and 4, FIG. 6 showing a cross-sectional view along lines VI—VI in FIG. 7, and FIG. 7 showing a view along lines VII—VII in FIG. 6.
Figure 6:
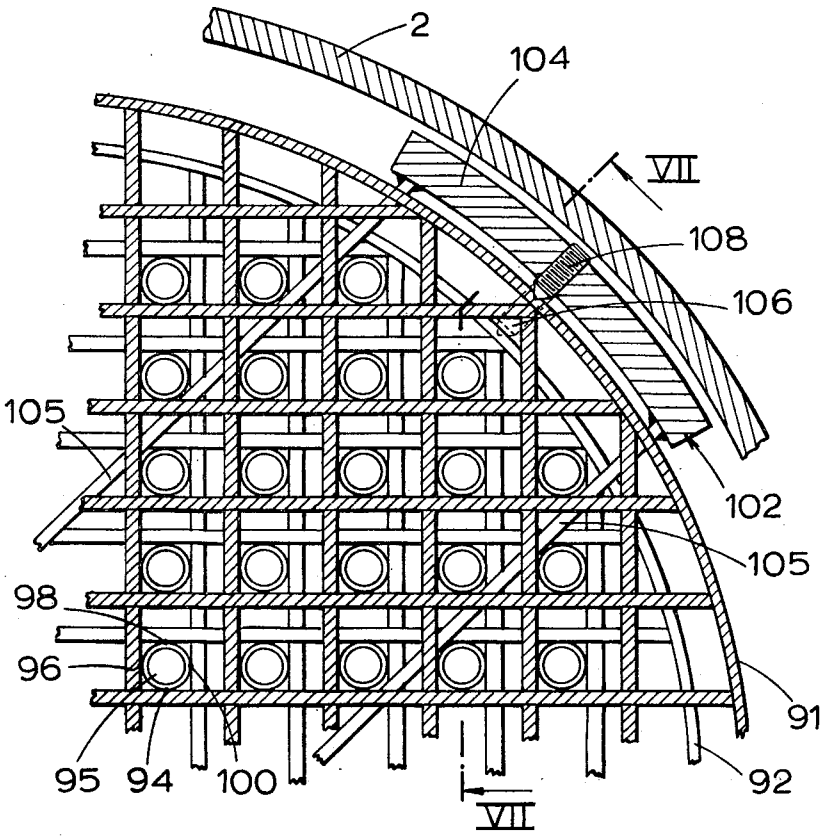

FIGS. 6 and 7 are detail views showing a cross-section and a longitudinal section, respectively, substantially corresponding to FIGS. 3 and 4 of a further embodiment of the invention. This embodiment is assumed particularly suitable for providing a large pitch between the tubes and wherein the bars which are utilized for the embodiment shown in FIGS. 2-5 would be unreasonably thick. It will be understood that from a gas flow standpoint it is advantageous to utilize bars which are as thin as possible while from a constructional point of view the bars should be sufficiently stiff in order to prevent the tubes from moving in an undesirable fashion during the operation of the heat exchanger. In this embodiment each supporting unit comprises two identical equal, individual grates 91 and 92, consisting of bars welded together. The grid masks are dimensioned in order to accurately correspond to the tube pitching in the bank, and they are designed to encompass only one single tube. When assembling the tube bank these grates are displaced and fixed diagonally in alternating fashion, that is 45° relative to the grid masks, until each separate tube receives a steady support at two opposed points, 90° angularly displaced at points on each grate, and one particular tube 95, arbitrarily selected, at the points 94, 96 in the grate 91 and the points 98, 100 in the grate 92. This embodiment distinguishes constructionally from the preceding embodiments in that each support grate comprises a unit having two grates 91 and 92 and which are supported mutually spaced in a common support frame 102 provided with diagonally opposed brackets 104 connected together with a radial bar 105 wherein the grates 91 and 92 can be adjustably fixed by means of threaded fastening elements 106, 108. This grate unit corresponds otherwise to one of those couple-wise units illustrated in FIG. 1, and such a mounting method can otherwise also be utilized for the embodiment shown in FIGS. 2-5. At assembly or mounting all tubes are initially pushed into their respective places in the grid masks in the grates, wherein the separate grates are fixed in correct position by adjusting the screw elements such that the grates in each unit are diagonally displaced such as best illustrated in FIG. 6, whereafter the entire unit is pushed into correct position in the mantle 2 and is fixed, for instance by welding, or by means of separate threaded elements.

In all embodiments of the invention, each tube is contacted by the grate bars of a given grate with a resultant pressure from substantially only one direction. For instance, in the embodiment of FIG. 3, the tube in the lower right corner is contacted by grate bar 56 by a resultant pressure directed substantially vertically. Similarly, in the embodiment of FIG. 6, tube 95 is contacted by two grate bars at points 94 and 96 to produce a resultant pressure directed substantially diagonally upwardly and to the right.

Furthermore, in all embodiments of the invention, the contact of each tube by the grate bars of a given grate occurs at points within less than one-half of the circumference of the tube, and the support of each tube contributed by each next adjacent axially spaced grate is alternatingly oppositely directed. For instance, in the embodiment of FIG. 3, the tube in the lower right corner is contacted by grate bar 56 at points determined by recess 70 within less than one-half the circumference of the tube, and grate bar 62 at the next axially adjacent grate contacts the tube in a similar but oppositely directed manner. Similarly, in the embodiment of FIG. 6, tube 95 is contacted by the grate bars of grate 91 at points 94 and 96 within less than one-half the circumference of the tube, and tube 95 is contacted by the grate bars of grate 92 at points 98 and 100 in a similar but oppositely directed manner.

Other constructional solutions can be realized within the scope of the invention, namely the alternating tensioning of the tubes in the bank at each second of the support grates for the bank. In the illustrated embodiments of the invention are only shown tube banks wherein the separate tubes in each plane are displaced a full tube pitch both in the tube plane and in the direction perpendicular thereto. In tube banks wherein the tubes in adjacent tube planes are displaced only one half tube pitch such that each three adjacent tubes in the bank may be circumscribed by equilateral triangles having 60° apex angles the invention can be utilized in a quite identical manner, either by means of parallel grate bars and/or bars extending at 60° apex angles. Alternatively one can utilize bar grates corresponding to those shown in FIGS. 5, 6 and 7, since the grates in a corresponding fashion can be realized as a net of masks having rhombic shape. Other configurations can also be realized.

We claim:

1. An arrangement of fixation of parallel spaced tubes in tube banks in heat exchangers with longitudinal flow externally of the tubes, said arrangement comprising:

a plurality of tube support grates spaced along the axes of said tubes, each grate having bars located within spacings between said tubes, said grate bars extending transversely of the direction of the axes of said tubes, said grate bars being positioned such that bars in any one grate contact and contribute to the support of said tubes by a resultant pressure from substantially only one direction and directed transversely of, and at points within less than one-half the circumference of each contacted tube, the support of each tube contributed by each next adjacent axially spaced grate being alternatingly oppositely directed.

2. A device as claimed in claim 1, wherein said grate bars extend through all spacings between said tubes; each said grate comprising a grid wherein the bars thereof are substantially thinner than the spacing between said tubes; and the fixation of said tubes is obtained by each second grate pressing said tubes in an opposite direction, preferably diagonally relative to the openings in said grids.

3. A device as claimed in claim 1, wherein said bars are straight, and have an even transverse thickness slightly greater than the spacing between adjacent of said tubes prior to positioning therebetween.

4. A device as claimed in claim 1, wherein said bars all extend in the same direction and have means for providing a lateral support for said tubes relative to the longitudinal direction of the bars.

5. A device as claimed in claim 1, wherein said grates are arranged in pairs, such that the longitudinal spacing between adjacent of said grates alternates between a maximum and a minimum.

6. A device as claimed in claim 1, wherein said bars have one longitudinal edge thereof, in the direction of flow, of a reduced thickness to reduce flow friction.

7. A heat exchanger including the device of claim 1, and further comprising means for laterally adjustably supporting said grates in said heat exhanger relative to the longitudinal centerline of said heat exchanger.

8. A heat exchanger as claimed in claim 7, wherein said means comprise threaded bolts circumferentially arranged in a mantle of said heat exchanger.

* * * * *